US006978032B2

(12) United States Patent
Ogura et al.

(10) Patent No.: US 6,978,032 B2
(45) Date of Patent: Dec. 20, 2005

(54) PIEZOELECTRIC SPEAKER

(75) Inventors: Takashi Ogura, Toyonaka (JP); Kousaku Murata, Kawanishi (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 123 days.

(21) Appl. No.: 10/305,344

(22) Filed: Nov. 27, 2002

(65) Prior Publication Data

US 2003/0099371 A1 May 29, 2003

(30) Foreign Application Priority Data

Nov. 29, 2001 (JP) ..... 2001-364062

(51) Int. Cl.[7] ..... H04R 25/00
(52) U.S. Cl. ..... 381/190
(58) Field of Search ..... 381/113, 114, 381/116, 190–191, 173, 399, 426

(56) References Cited

U.S. PATENT DOCUMENTS 2,414,489 A * 1/1947 Shomer ..... 381/190
3,423,543 A * 1/1969 Kompanek ..... 381/152
3,728,562 A * 4/1973 Herson et al. ..... 310/326
3,894,198 A * 7/1975 Murayama et al. ..... 381/114
6,453,050 B1 * 9/2002 Ogura et al. ..... 381/190
2002/0186860 A1 * 12/2002 Ogura et al. ..... 381/398

FOREIGN PATENT DOCUMENTS

EP 1 175 126 1/2002
JP 2001-16692 1/2001

* cited by examiner

*Primary Examiner*—Curtis Kuntz
*Assistant Examiner*—P. Dabney
(74) *Attorney, Agent, or Firm*—Wenderoth, Lind & Ponack, L.L.P.

(57) ABSTRACT

A piezoelectric speaker improved in acoustic features by weight reduction of a diaphragm of the piezoelectric speaker without decreasing stiffness of the diaphragm or a coefficient of thermal expansion of surfaces of the piezoelectric speaker is provided. The diaphragm having placed thereon a piezoelectric element is made of a sandwich-laminate clad material using different materials. For example, surface materials made of 42 alloy each having a thickness of 10 μm and a core material made of aluminium having a thickness of 30 μm form a clad material having a thickness of 50 μm. The formed clad material is processed into an arbitrary shape to form the diaphragm of the piezoelectric speaker. With this diaphragm, it is possible to keep the stiffness and the coefficient of thermal expansion of the 42-alloy diaphragm having the thickness of 50 μm, and also achieve weight reduction by approximately 40%.

10 Claims, 12 Drawing Sheets

RELATION BETWEEN RATE OF INCREASE IN BENDING STIFFNESS AND WEIGHT (COMPARED WITH 50 μm 42 ALLOY)

RELATION BETWEEN BENDING STIFFNESS AND WEIGHT (COMPARED WITH 100 μm 42 ALLOY)

PIEZOELECTRIC SPEAKER

BACKGROUND OF THE INVENTION

1. Field of the Invention

The present invention relates to a piezoelectric speaker for acoustic equipment.

2. Description of the Background Art

Piezoelectric speakers are known as small-sized, low-current-driven acoustic components using a piezoelectric element as an electric acoustic conversion element, and are used as an acoustic output device for small-sized electric equipment. Generally speaking, the piezoelectric speaker has a structure such as that of a metal diaphragm pasted with a piezoelectric element having an electrode such as a silver film. An alternating voltage applied to both surfaces of the piezoelectric element deforms the piezoelectric element to vibrate the diaphragm, thereby producing sound.

In conventional piezoelectric speakers, as disclosed in Japanese Patent Laid-Open Publication 2001-16692, for example, the diaphragm is supported so as to vibrate linearly, thereby flattening frequency characteristics. Therefore, in general, the diaphragm of the piezoelectric speaker is made solely of 42 stainless alloy (42Ni—Fe: hereinafter referred to as 42 alloy), because the 42 alloy has a coefficient of thermal expansion close to that of a PZT (lead zirconate titanate) piezoelectric material.

Here, the lighter in weight the diaphragm of the piezoelectric speaker, the better the sound pressure level per unit energy. Therefore, for piezoelectric speakers incorporated in portable terminal devices requiring long battery life and low voltage drive, a reduction in weight of the diaphragm is crucial for achieving better acoustic features.

The diaphragm of the piezoelectric speaker should also have appropriate stiffness. When the piezoelectric element has a thickness of approximately 50 $\mu$m (micrometer), the thickness of the diaphragm made of 42 alloy is in a range of approximately 50 to 100 $\mu$m. If the diaphragm is thinner than the above range, the stiffness of the diaphragm is decreased, causing difficulties in stably supporting the piezoelectric element and sufficiently converting shape distortion of the piezoelectric element into vibration. If the diaphragm is thicker than the above range, the stiffness thereof is extremely increased. Therefore, vibration of the diaphragm cannot be obtained, leading to a reduction in sound pressure level. For this reason, the diaphragm of the conventional piezoelectric speaker cannot be made extremely thin for weight reduction because of the requirement of appropriate stiffness to maintain acoustic features. Also, the diaphragm of the conventional piezoelectric speaker is made solely of metal material (42 alloy) having a high density in accordance with the coefficient of thermal expansion of the piezoelectric material. Therefore, it has been difficult to achieve a reduction in weight of the diaphragm with different materials. It has also been difficult to achieve an improvement in sound pressure level per unit energy that would have been brought by weight reduction.

SUMMARY OF THE INVENTION

Therefore, an object of the present invention is to provide a piezoelectric speaker improved in acoustic features by weight reduction of a diaphragm of the piezoelectric speaker without decreasing stiffness of the diaphragm or a coefficient of thermal expansion of surfaces of the piezoelectric speaker.

The present invention has the following features to attain the object mentioned above.

An aspect of the present invention is directed to a piezoelectric speaker including a piezoelectric element; and a diaphragm having placed thereon the piezoelectric element to form a vibrator. The diaphragm is made of a clad material having layers of at least two different materials laminated together to form a sandwich structure in cross section.

According to the above structure, it is possible to achieve reduction in weight of the diaphragm by combining light-weight materials, compared with a diaphragm made of single material. Also, with the sandwich structure of different materials, the diaphragm having required stiffness can be easily designed. Therefore, the diaphragm can achieve required stiffness and light weight simultaneously. With such a light-weight diaphragm, the sound pressure level of the piezoelectric speaker can be improved.

The clad material may include two surface layers made of a first material to form both surfaces of the diaphragm; and a single core layer made of a second material that is different from the first material, and bonded between the two surface layers. With three-layer clad material made of two different materials, the diaphragm having the required stiffness can be easily designed and manufactured.

A coefficient of thermal expansion of the first material may be close to a coefficient of thermal expansion of the piezoelectric element. The density of the second material may be lower than a density of the first material. With this, it is possible to achieve a light-weight diaphragm having a coefficient of thermal expansion of the surface material of the diaphragm close to that of the piezoelectric element. Therefore, thermal exfoliation of the surface material from the piezoelectric element and thermal material destruction such as cracking can be avoided. That is, with the material having the core layer lighter in weight than that of the surface layers, it is possible to achieve a light-weight diaphragm having a coefficient of thermal expansion close to that of the piezoelectric element. Also, the surface layer may be thinner than the core layer. In this case, since the light-weight core layer forms a large proportion of the diaphragm, it is possible to achieve effects of further reducing the weight of the diaphragm.

The first and second materials may be ones selected out of a metal film and a film made of high polymer resin. This provides improved flexibility in selecting the materials for constructing the diaphragm. Furthermore, the first material may be the metal film made of 42 alloy stainless, and the second material may be one selected out of the metal film made of metal other than the 42 alloy stainless, and the film made of high polymer resin. Therefore, when the piezoelectric element is made of lead zirconate titanate (PZT) as generally used, the coefficient of thermal expansion of the surface layers becomes close to that of the piezoelectric element. With this construction, thermal exfoliation of the surface material from the piezoelectric element and thermal material destruction such as cracking can be avoided. Also, with the material of the core layer lighter in weight than 42 alloy stainless, it is possible to achieve a light-weight diaphragm having the coefficient of thermal expansion close to that of the PZT piezoelectric element. Still further, the second material may be a film made of aluminium. With the surface layers made of 42 alloy stainless and the core layer made of aluminium, it is possible to easily achieve the above-mentioned diaphragm.

Still further, the piezoelectric speaker may further include a frame portion surrounding the diaphragm; a damper portion connecting the frame portion and the diaphragm, and supporting the diaphragm so that the diaphragm can linearly vibrate; and an edge portion formed in an area delineated by the diaphragm, the damper portion, and the frame portion. The clad material having the layers made of the first and second materials laminated together may be subjected to a predetermined process to integrally form the diaphragm, the damper portion, and the frame portion. With the diaphragm, the damper portion, and frame portion integrally formed of the clad material, a speaker portion of the piezoelectric speaker can be easily formed. Still further, the edge portion may be formed by, for example, filling a material that is different from the first and second materials in a space formed among the diaphragm, the damper portion, and the frame portion. In this case, the edge portion for flattening frequency characteristics of the piezoelectric speaker can be appropriately formed. In another example, the edge portion may be formed by performing an etching process onto only the first material in the area delineated among the diaphragm, the damper portion, and the frame portion. In this case, the edge portion for flattening frequency characteristics of the piezoelectric speaker can be easily formed only by the etching process. Still further the frame portion may be provided with one electrode for applying a driving voltage to the piezoelectric element. In this case, when the frame portion is taken as one of electrodes, electricity is conducted to the diaphragm through the damper portion. Therefore, the piezoelectric element can be driven without taking the diaphragm as one of the electrodes. This can dispense with wiring directly to the diaphragm, thereby stabilizing vibration characteristics of the diaphragm.

Still further, the piezoelectric element may further include a frame portion surrounding the diaphragm and integrally formed of the clad material of the diaphragm. At least a part of the clad material may be made of an insulating material, and the frame portion may be provided with a circuit portion formed by performing an etching process onto at least a part of the layers constructing the clad material into a predetermined shape. With this, the frame portion and the circuit portion of the piezoelectric speaker can be integrally formed.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
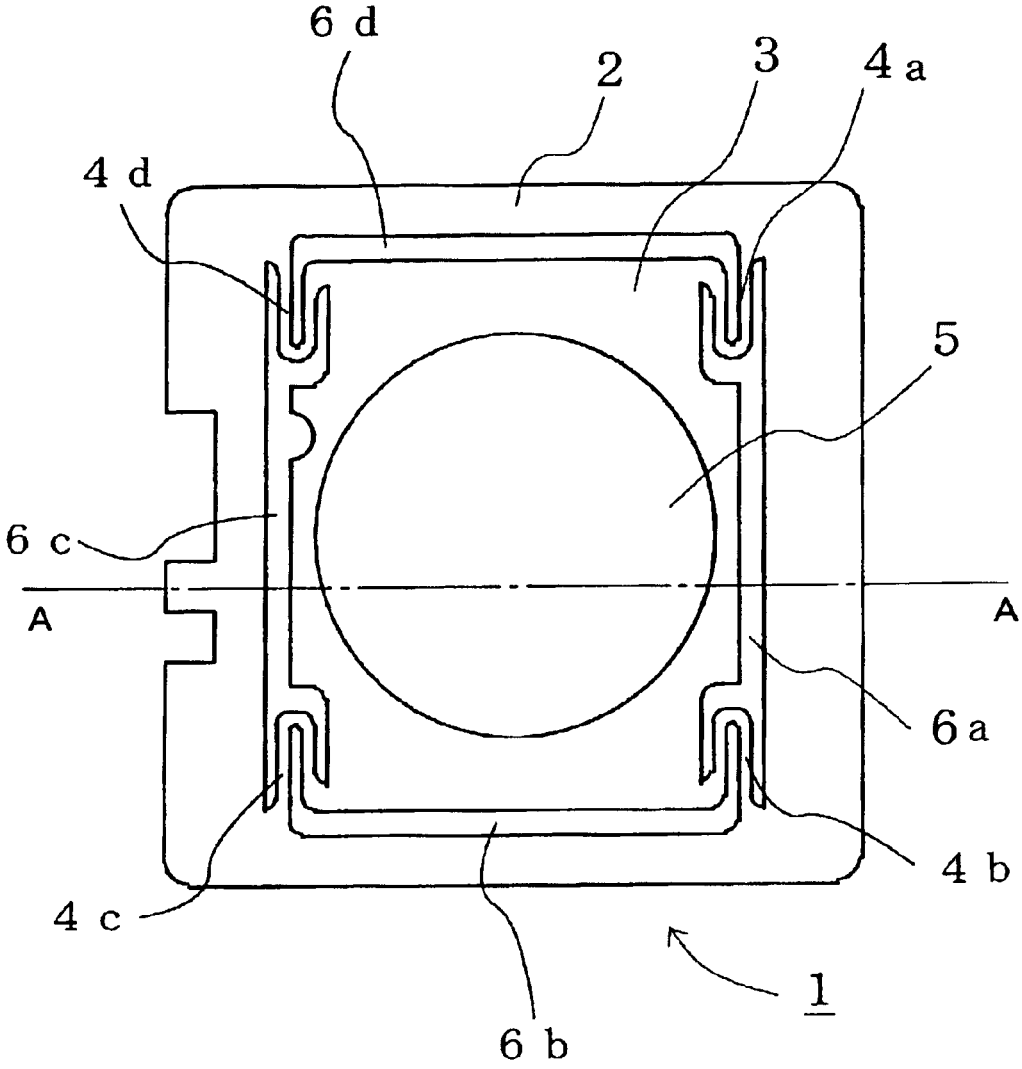
FIG. 1 is a schematic top plan view of a piezoelectric speaker 1 having an exemplary structure according to one embodiment of the present invention.

With reference to FIG. 1, a piezoelectric speaker according to one embodiment of the present invention is described. FIG. 1 is a schematic top plan view of the piezoelectric speaker having an exemplary structure.

In FIG. 1, a piezoelectric speaker 1 includes a frame portion 2, a diaphragm 3, a plurality of damper portions 4*a* through 4*d*, a piezoelectric element 5, and edge portions 6*a* through 6*d*. The frame portion 2, the diaphragm 3, and the damper portions 4*a* through 4*d* are integrally formed by etching or stamping a flat sandwich laminate with press forming or the like. The rectangular-like-shape diaphragm 3 is connected to the rectangular-like-shape frame portion 2 via the damper portions 4*a* through 4*d* each being bended into a U-like shape to serve as an arm-like bridge between the diaphragm 3 and the frame portion 2. The damper portions 4*a* through 4*d* are also called wing dampers derived from their shape. The frame portion 2 is fixed to a fixing member (not shown) of the piezoelectric speaker 1. Hereinafter, the damper portions 4*a* through 4*d* are simply called damper portions 4 when the distinction thereamong is not especially required.

The circular-like piezoelectric element 5 is a driving source of the piezoelectric speaker 1, and is joined to the rectangular-like-shape diaphragm 3 with, for example, an acrylic-type adhesive. The piezoelectric element 5 is made of PZT (lead zirconate titanate) piezoelectric material or the like. With a predetermined portion of the piezoelectric element 5, and the diaphragm 3 or the frame portion 2 taken as electrodes, a predetermined alternating voltage is applied from a piezoelectric speaker driving apparatus (not shown) to these electrodes. With such an alternating voltage applied to the piezoelectric element 5, the piezoelectric element 5 is distorted in shape to vibrate the diaphragm 3, thereby producing sound and/or music from the piezoelectric speaker 1. Here, when the frame portion 2 is taken as one of the electrodes, electricity is conducted to the diaphragm 3 through the plurality of damper portions 4. Therefore, the piezoelectric element 5 can be driven without taking the diaphragm 3 as one of the electrodes. This can dispense with wiring directly to the diaphragm 3, thereby stabilizing vibration characteristics of the diaphragm 3.

The edge portions 6*a* to 6*d* are formed by filling four slot-like spaces provided on the flat sandwich laminate at the respective sides of the diaphragm 3 between the frame portion 2 and the diaphragm 3 with a resin having an adequate elasticity such as a high polymer resin. Hereinafter, the edge portions 6*a* through 6*d* are simply called edge portions 6 when the distinction thereamong is not especially required. For example, the edge portions 6 are formed by applying a liquid high-polymer resin having elasticity (rubber elasticity) after curing to the flat sandwich laminate having formed thereon the frame portion 2, the diaphragm 3, and the damper portions 4*a* through 4*d*. The cured high polymer resin is held in a space between the diaphragm 3 and the frame portion 2. Alternatively, the edge portions 6 may be formed by using a capillary phenomenon caused by the surface tension of the liquid high-polymer resin to fill the space therewith. Still alternatively, the edge portions 6 may be formed by pasting an elastic sheet on a top surface and a bottom surface of the flat sandwich laminate having formed thereon the frame portion 2, the diaphragm 3, and the damper portions 4*a* through 4*d* and having placed thereon the piezoelectric element 5. The elastic sheets to be used are, for example, rubber thin films, or elastic woven or unwoven fabrics dipped in or coated with a resin having rubber elasticity for sealing. Exemplary rubber thin films are rubber-type high-polymer resin films made of, for example, styrene-butadiene rubber (SBR), butadiene rubber (BR), acrylonitrile-butadiene rubber (NBR), ethylene-propylene rubber (EPM), ethylene-propylene-diene rubber (EPDM), or their metamorphoses. Exemplary woven or unwoven fabrics are polyurethane fibers. Still further, in a case where the sandwich laminate is made of rubber-type high-polymer resin for a core material (will be described further below) and also of metal for a surface material, the edge portions 6 may be formed by etching only the surface material of the sandwich laminate. In this case, the edge portions 6 are formed only by an etching process.

The diaphragm 3 can have linear vibration characteristics with the support by the above-mentioned damper portions 4, the difference in shape from the piezoelectric element 5, and the construction of the edge portions 6 that prevent air leakage from the slots. Such linear vibration characteristics of the diaphragm 3 enables reproduction of sound in a low frequency band and prevention of a peak dip representing a large difference in sound pressure level from occurring in acoustic features. A mechanism for achieving the linear vibration characteristics of the diaphragm 3 is well known, and therefore is not described in more detail herein.

Figure 2:
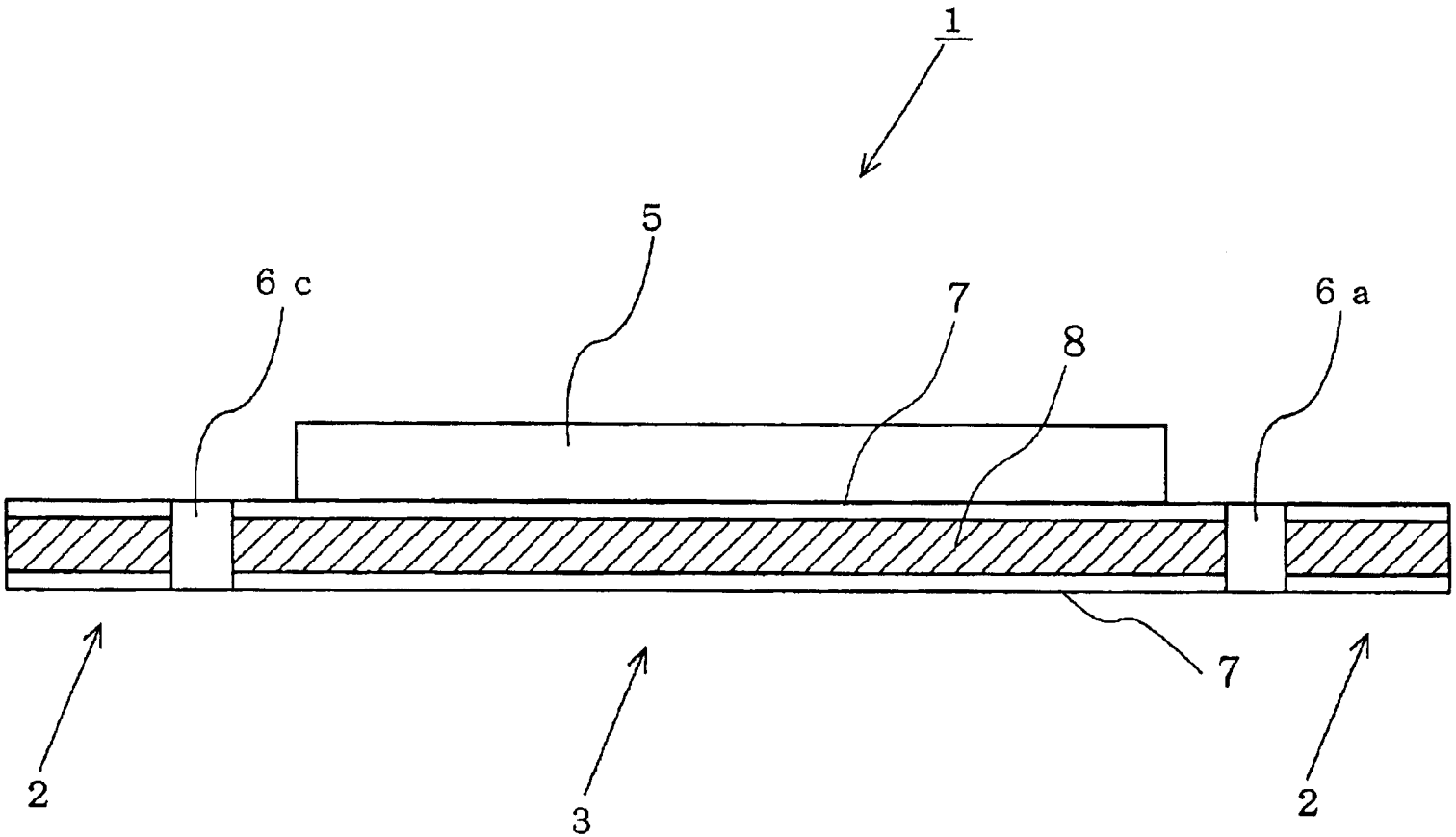
FIG. 2 is a cross-sectional view of the piezoelectric speaker 1 of FIG. 1 taken along a line A—A.
Figure 3:
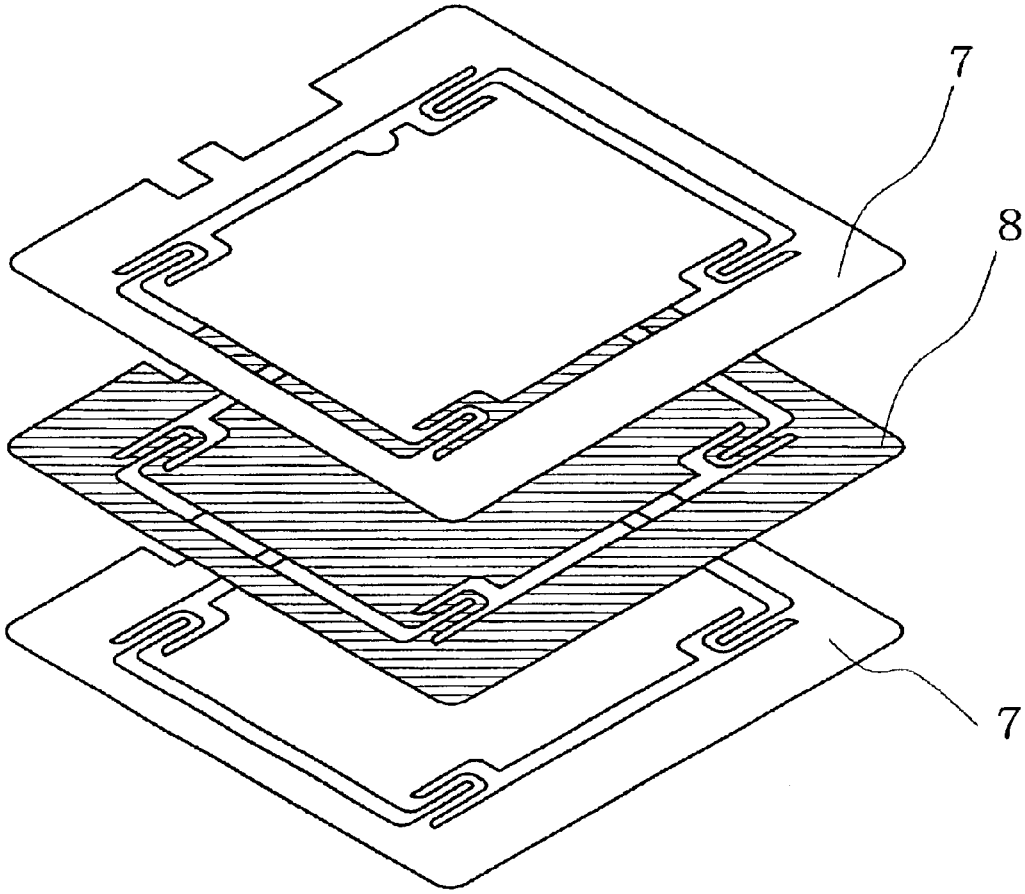
FIG. 3 is an exploded perspective view of the piezoelectric speaker 1 of FIG. 1 showing respective layers constructing a sandwich laminate.

With reference to FIGS. 2 and 3, the sandwich laminate forming the frame portion 2, the diaphragm 3, and the damper portions 4 is described below. FIG. 2 is a cross-sectional view of the piezoelectric speaker 1 of FIG. 1 taken along a line A—A. FIG. 3 is an exploded perspective view of the piezoelectric speaker 1 of FIG. 1 showing respective layers constructing the sandwich laminate.

In FIGS. 2 and 3, as described above, the frame portion 2, the diaphragm 3, and the damper portions 4 are formed by etching or stamping the flat sandwich laminate (hereinafter also referred to as diaphragm material). As illustrated in FIGS. 2 and 3, the flat diaphragm material has a composite three-layer structure in which a core material 8 is taken as an intermediate layer and is sandwiched between surface materials 7 on top and bottom. Such a flat material is also called a clad material. For example, for the purpose of forming the diaphragm material so as to have a thickness of 50 μm (micrometer), 42 alloy stainless material (42Ni—Fe: hereinafter referred to as 42 alloy) having a thickness of 10 μm is used for the surface materials 7 to sandwich the core material 8, thereby forming a three-layer diaphragm material having a thickness of 50 μm. For the core material 8, light-weight aluminium having a thickness of 30 μm is used. Therefore, the resultant composite diaphragm material is made of two different materials to have the sandwich structure with the core material 8 sandwiched between the surface materials 7. It is preferable that the two different materials be bonded together with Van der Waals force rather than with an adhesive in order to minimize the effect of bonding material. For example, the surface materials 7 and the core material 8 are welded by pressure and rolling within a vacuum by ion etching for bonding.

The stiffness of the above-described diaphragm material is described below. Normally, the bending stiffness of a single material having uniform physical characteristics is calculated by multiplying a modulus of elasticity by a moment of inertia thereof. Based on this calculation, the following equation (1) is formulated for calculating the bending stiffness when two types of materials are used:

[Equation 1]

$$[EI]_f = \frac{W_f^3}{12b^2} \times \left[ \frac{E_s}{\rho_s^3} \frac{\{1 - r^3(1 - E_c/E_s)\}}{\{1 - r(1 - \rho_c/\rho_s)\}^3} \right] \quad (1)$$

Here, $W_f = \rho_f t_f b$ $r = t_c/t_f$, and $[EI]_f$: entire stiffness $E_c$: modulus of elasticity of a core material $E_s$: modulus of elasticity of a surface material $\rho_c$: density of the core material $\rho_s$: density of the surface material $\rho_f$: entire density $t_c$: layer thickness of the core material $t_s$: thickness of the surface material $t_f$: entire thickness b: width of a sample (a composite of the core material and the surface materials) for simulation $W_f$: weight per unit length (linear density)

r: ratio of thickness between the core material and the surface material

With the above equation (1), it is possible to find the entire bending stiffness of the diaphragm material having the three-layer structure in which the core material and the surface material are different in material from each other and are bonded together without any intervening layer, such as a bonding layer, that is different in material from the core material and the surface material. In this equation (1), the surface materials used on the top and bottom surfaces should have the same thickness, but the core material and the surface materials do not have to have the same thickness. For example, consider a case where a sandwich-structured diaphragm material is to be designed so as to have a stiffness similar to that of 42 alloy material having a thickness of 50 μm used for a conventional piezoelectric speaker. With the above equation (1), it can be known that the above stiffness can be achieved by using the surface material 7 made of 42 alloy having a thickness of 10 μm and the core material 8 made of aluminium having a thickness of 30 μm to form a diaphragm material having a thickness of 50 μm.

Figure 4:
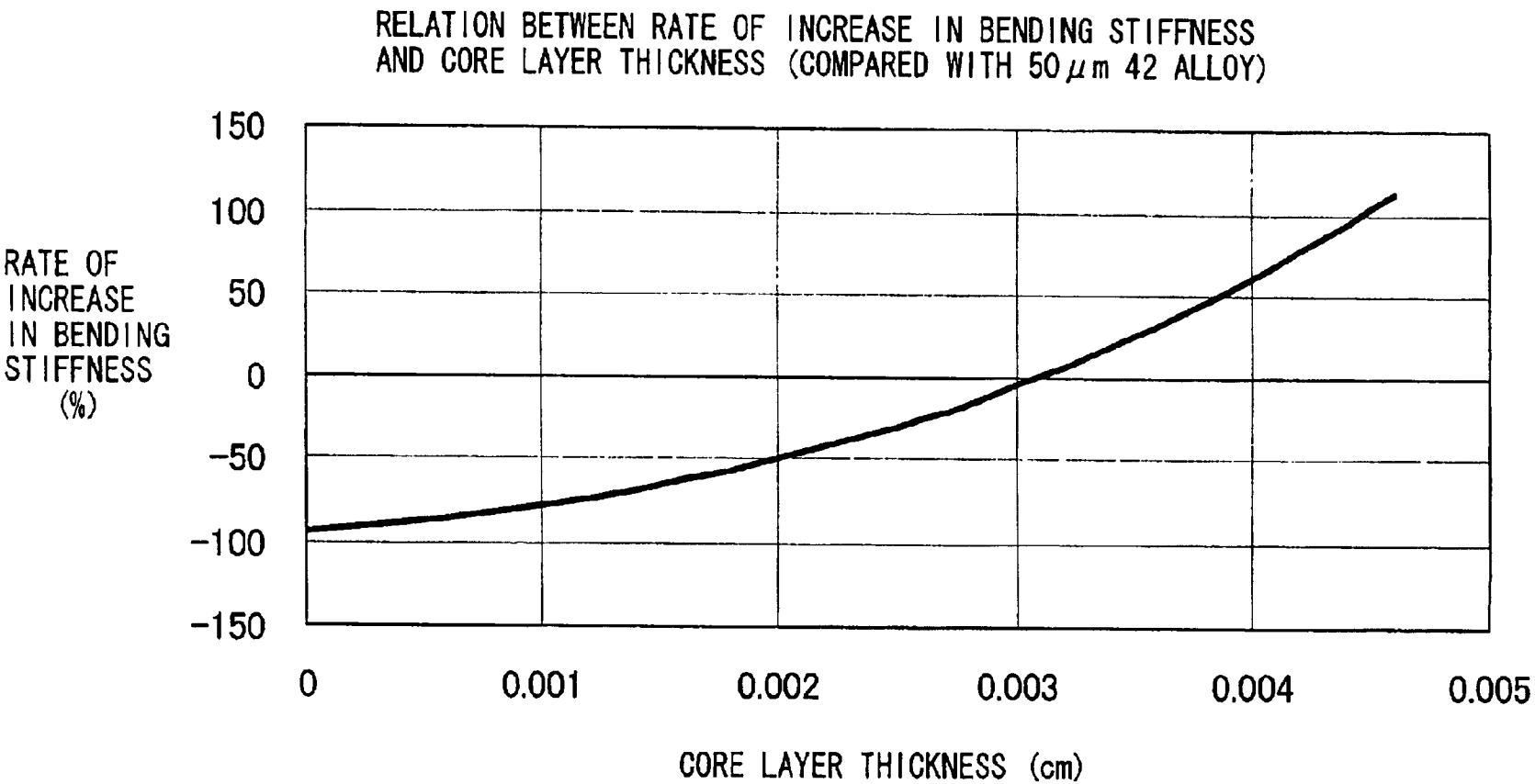
FIG. 4 is a graph showing a relation between a rate of increase in bending stiffness of a diaphragm for use in the piezoelectric speaker 1 of FIG. 1 and a layer thickness of a core material 8.

With reference to FIG. 4, a rate of increase in the entire bending stiffness that varies by changing the layer thickness of the core material 8 of the diaphragm material is described below. FIG. 4 is a graph obtained through simulations by using the above equation (1), showing a relation between the rate (%: percentage) of increase in bending stiffness and the thickness (cm: centimeter) of the core material 8.

In FIG. 4, the rate (%) of increase in bending stiffness indicated on the vertical axis of the graph is calculated with reference to the above-mentioned 42 alloy material having the thickness of 50 $\mu$m used for the conventional piezoelectric speaker. On the other hand, the horizontal axis thereof indicates a core layer thickness (cm) representing the thickness of the aluminium used as the core material 8. Here, the surface materials 7 used on both the top and bottom surfaces are made of 42 alloy having a constant thickness of 10 $\mu$m. As illustrated in FIG. 4, when the rate of increase in bending stiffness is 0% (that is, the bending stiffness is the same as that of the 42 alloy material having the thickness of 50 $\mu$m used for the conventional piezoelectric speaker), the core layer thickness is approximately 0.003 cm. Therefore, by using the 42 alloy having the thickness of 10 $\mu$m as the surface materials 7 and the aluminium having the thickness of 30 $\mu$m as the core material 8, the diaphragm material having the thickness of 50 $\mu$m of the present invention can be made closer in bending stiffness to the diaphragm material made solely of the 42 alloy having the total thickness of 50 $\mu$m.

Figure 5:
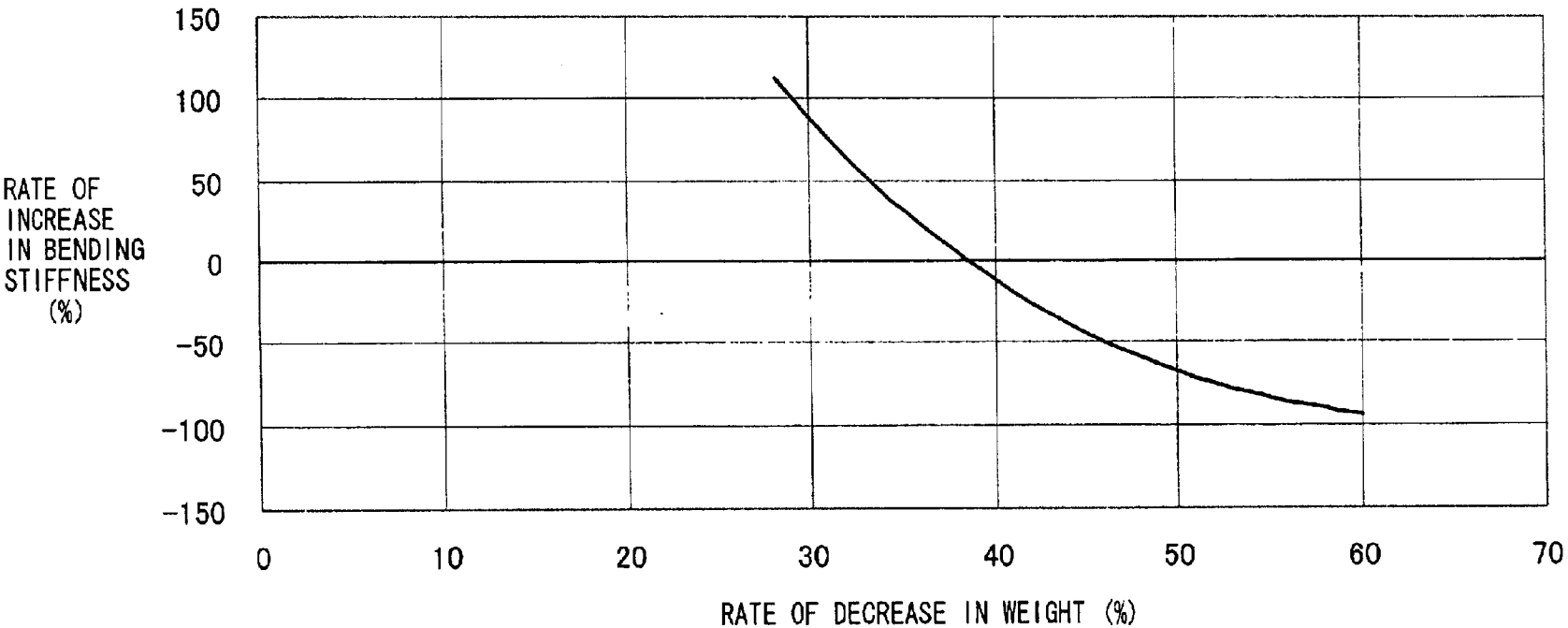
FIG. 5 is a graph showing a relation between the rate of increase in bending stiffness of the diaphragm for use in the piezoelectric speaker 1 of FIG. 1 and a rate of decrease in weight thereof.

With reference to FIG. 5, a rate of decrease in weight with respect to the above-mentioned rate of increase in bending stiffness is described below. FIG. 5 is a graph obtained through simulations by using the above equation (1), showing a relation between the rate (%) of increase in bending stiffness and the rate (%) of decrease in weight.

In FIG. 5, the rate (%) of increase in bending stiffness indicated on the vertical axis of the graph and the rate (%) of decrease in weight indicated on the horizontal axis thereof are calculated with reference to those of the above-mentioned 42 alloy material having the thickness of 50 $\mu$m used for the conventional piezoelectric speaker. In either rate, the surface materials 7 are made of the 42 alloy having a constant thickness of 10 $\mu$m, but the core material 8 made of aluminium has a varying thickness so as to vary the entire bending stiffness and weight. As illustrated in FIG. 5, when the rate of increase in bending stiffness is 0% (that is, when the bending stiffness is the same as that of the above-mentioned 42 alloy material having the thickness of 50 $\mu$m used for the conventional piezoelectric speaker), the rate of decrease in weight is approximately 40%. On the other hand, as described above, in the diaphragm material of the present invention, when the rate of increase in bending stiffness is 0%, the layer thickness of the core material 8 is 30 $\mu$m. Therefore, when the core material 8 made of the aluminium having a thickness of 30 $\mu$m is sandwiched between the surface materials 7 made of the 42 alloy each having the thickness of 10 $\mu$m to form the diaphragm having the total thickness of 50 $\mu$m, the resultant diaphragm has a bending stiffness similar to that of the conventional diaphragm made solely of the 42 alloy having the total thickness of 50 $\mu$m, but weights approximately 60% of the conventional diaphragm. That is, the diaphragm material of the present invention can have the same thickness as that of the conventional diaphragm material with the bending stiffness and a thermal coefficient of expansion similar to those of the conventional diaphragm material, and can also achieve light weight.

Figure 6:
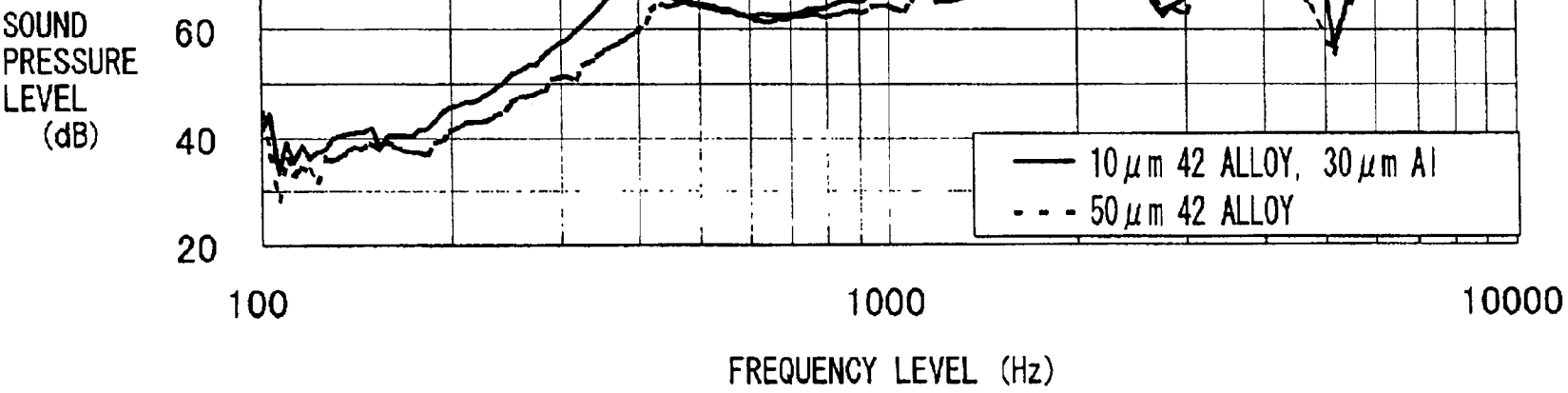
FIG. 6 is a graph showing a comparison in acoustic features between the piezoelectric speaker 1 of FIG. 1 and a conventional piezoelectric speaker whose diaphragm is composed solely of 42 alloy.

With reference to FIG. 6, the acoustic features of the piezoelectric speaker 1 using the sandwich-laminate diaphragm material are shown. FIG. 6 is a graph showing a comparison in acoustic features between the piezoelectric speaker 1 of FIG. 1 and a conventional piezoelectric speaker whose diaphragm is composed solely of 42 alloy.

In FIG. 6, the horizontal axis of the graph indicates a frequency level (Hz: Hertz) of sound produced from the piezoelectric speaker, while the vertical axis of the graph indicates a sound pressure level (dB: decibel) of the sound. The conventional piezoelectric speaker having the acoustic features denoted by a dotted line in the graph is constructed so that the diaphragm thereof is made solely of the 42 alloy having the thickness of 50 $\mu$m. The piezoelectric speaker 1 of the present invention having acoustic features denoted by a solid line in the graph is constructed so that the diaphragm 3 thereof has the surface materials 7 made of the 42 alloy each having the thickness of 10 m and the core material 8 made of the aluminium having the thickness of 30 $\mu$m. As illustrated in FIG. 6, the acoustic features of the piezoelectric speaker 1 of the present invention are improved in sound pressure level (by approximately 4 dB on the average), compared with the conventional acoustic features.

As such, according to the piezoelectric speaker of the present invention, the diaphragm having the piezoelectric element pasted thereon is made of sandwich-laminate clad material formed by different materials. With such a material, it is possible to achieve light weight of the diaphragm while maintaining the stiffness and the thermal coefficient of expansion of the conventional diaphragm. Therefore, compared with the conventional art, the sound pressure level of the piezoelectric speaker can be improved while maintaining the stiffness of the diaphragm.

Figure 7:
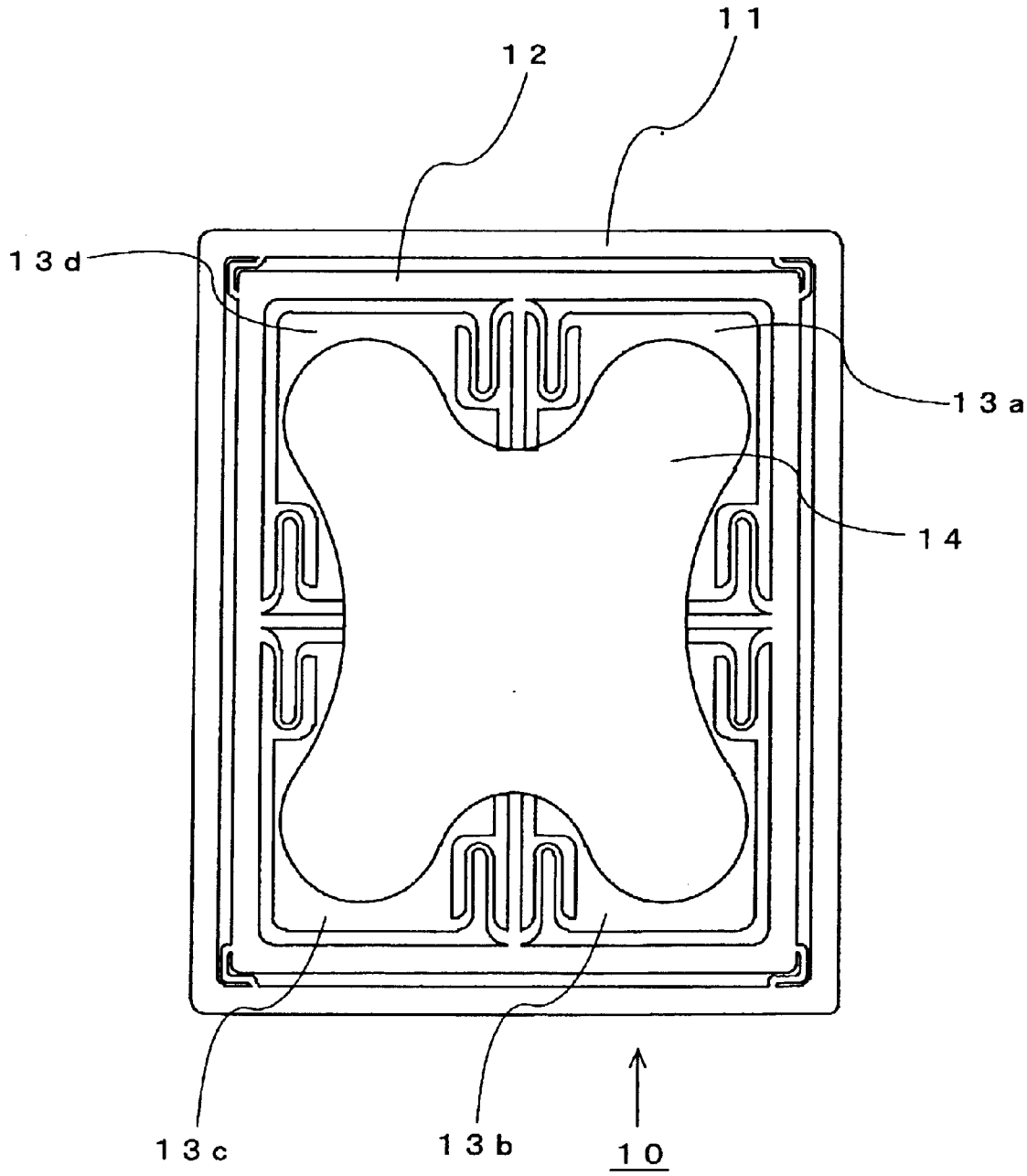
FIG. 7 is a schematic top plan view of a piezoelectric speaker 10 having another exemplary structure according to the embodiment of the present invention.
Figure 8:
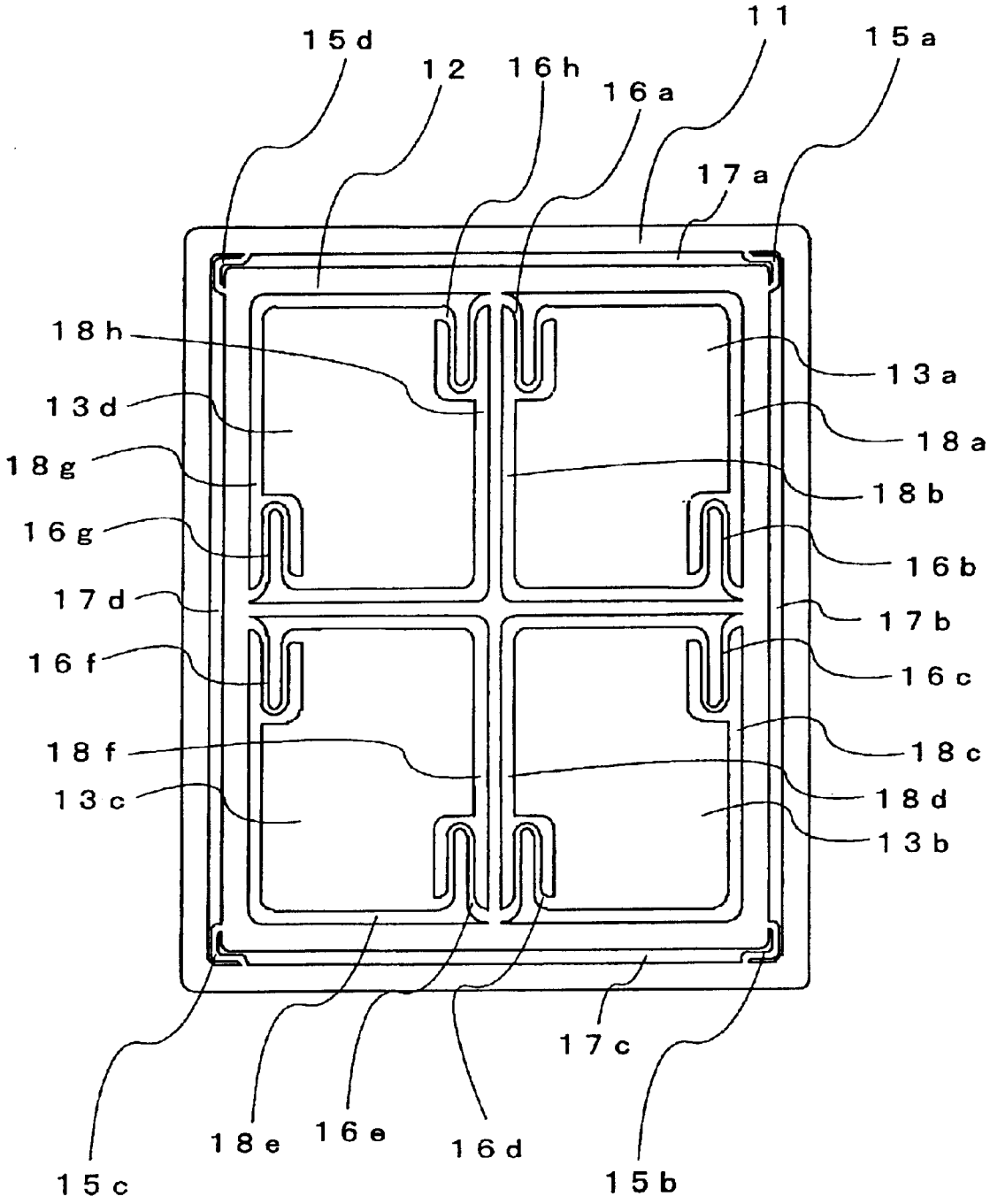
FIG. 8 is a top plan view of a diaphragm material having a structure of the piezoelectric speaker 10 of FIG. 7 with a piezoelectric element 14 removed therefrom.

Note that the above-described shape and thickness of the piezoelectric speaker according to the present invention are merely examples. The effect of the diaphragm material in the present invention does not change with the shape and thickness of the piezoelectric speaker. With reference to FIGS. 7 and 8, a piezoelectric speaker according to the present invention having another exemplary shape and thickness is described below. FIG. 7 is a schematic top plan view of a piezoelectric speaker 10 having another exemplary structure. FIG. 8 is a top plan view of a diaphragm material having a structure of the piezoelectric speaker 10 of FIG. 7 with a piezoelectric element 14 removed therefrom.

In FIGS. 7 and 8, the piezoelectric speaker 10 includes an outer frame portion 11, an inner frame portion 12, diaphragms 13*a* through 13*d*, a piezoelectric element 14, damper portions 15*a* through 15*d* and 16*a* through 16*h*, and edge portions 17*a* through 17*d* and 18*a* through 18*h*. The outer frame portion 11, the inner frame portion 12, the diaphragms 13*a* through 13*d*, the damper portions 15*a* through 15*d* and 16*a* through 16*h*, and the edge portions 17*a* through 17*d* and 18*a* through 18*h* are integrally formed by etching or stamping the above-described flat sandwich-laminate clad material with press forming or the like. The rectangular-like-shape diaphragm 13*a* is connected to the lattice-shape inner frame portion 12 via the damper portions 16*a* and 16*b* each being bended in a U-like shape to serve as an arm-like bridge between the diaphragm 13*a* and the inner frame portion 12. Similarly, the diaphragm 13*b* is connected to the inner frame portion 12 via the damper portions 16*c* and 16*d*; the diaphragm 13*c* is connected thereto via the damper portions 16*e* and 16*f*; and the diaphragm 13*d* is connected thereto via the damper portions 16*g* and 16*h*. The inner frame portion 12 is connected to the outer frame portion 11 via the damper portions 15*a* through 15*d*. The outer frame portion 11 is fixed to a fixing member (not shown) of the piezoelectric speaker 10.

The piezoelectric element 14 is a driving source of the piezoelectric speaker 10, and is bonded to all of the diphragm diaphragms 13*a* through 13*d* with, for example, an acrylic-type adhesive. The piezoelectric element 14 is made of PZT piezoelectric material or the like. The piezoelectric element 14 has a cross-like shape so as to avoid the above-described damper portions 16*a* through 16*h* and transmit vibration to the diaphragms 13*a* through 13*d*.

The edge portions 18*a* and 18*b* are formed by filling four slot-like spaces provided on the above-mentioned flat sandwich laminate at respective sides of the diaphragm 13*a* between the inner frame portion 12 and the diaphragm 13*a* with a resin having an adequate elasticity such as a high polymer resin. Similarly, the edge portions 18*c* and 18*d* are formed by filling with the above resin between the diaphragm 13*b* and the inner frame portion 12; the edge portions 18*e* and 18*f* are formed by filling with the above resin between the diaphragm 13*c* and the inner frame portion 12; the edge portions 18*g* and 18*h* are formed by filling with the above resin between the diaphragm 13*d* and the inner frame portion 12. Also, the edge portions 17*a* through 17*d* are formed by filling four slot-like spaces provided on the above-mentioned flat sandwich laminate at respective sides of the inner frame portion 12 between the outer frame portion 11 and the inner frame portion 12 with a resin having an adequate elasticity such as a high polymer resin. A method of forming the edge portions 17*a* through 17*d* and 18*a* through 18*h* is similar to that of forming the edge portion 6, and is therefore not described in more detail herein.

As the diaphragm material used for the above-shaped piezoelectric speaker 10, the above-described sandwich-laminate clad material can also be used. For example, for the purpose of forming a composite diaphragm material having a thickness of 100 μm, the surface materials made of 42 alloy each having a thickness of 20 μm and the core material made of light-weight metal, such as aluminium, having a thickness of 60 μm are bonded together, thereby obtaining a three-layer diaphragm material having a total thickness of 100 μm.

The stiffness of the above-described diaphragm material is described below. Also as for the diaphragm material, the above equation (1) is used to calculate the bending stiffness when the above-mentioned two types of materials are used. For example, consider a case where a sandwich-structured diaphragm material is to be designed so as to have a stiffness similar to that of a 42 alloy material having a thickness of 100 μm used for a conventional piezoelectric speaker. With the above equation (1), it can be known that the stiffness approximately equal to that of the conventional diaphragm material can be achieved by using the surface materials made of the 42 alloy having the thickness of 20 μm and the core material made of the aluminium having the thickness of 60 μm to form a diaphragm material having a thickness of 100 μm.

Figure 9:
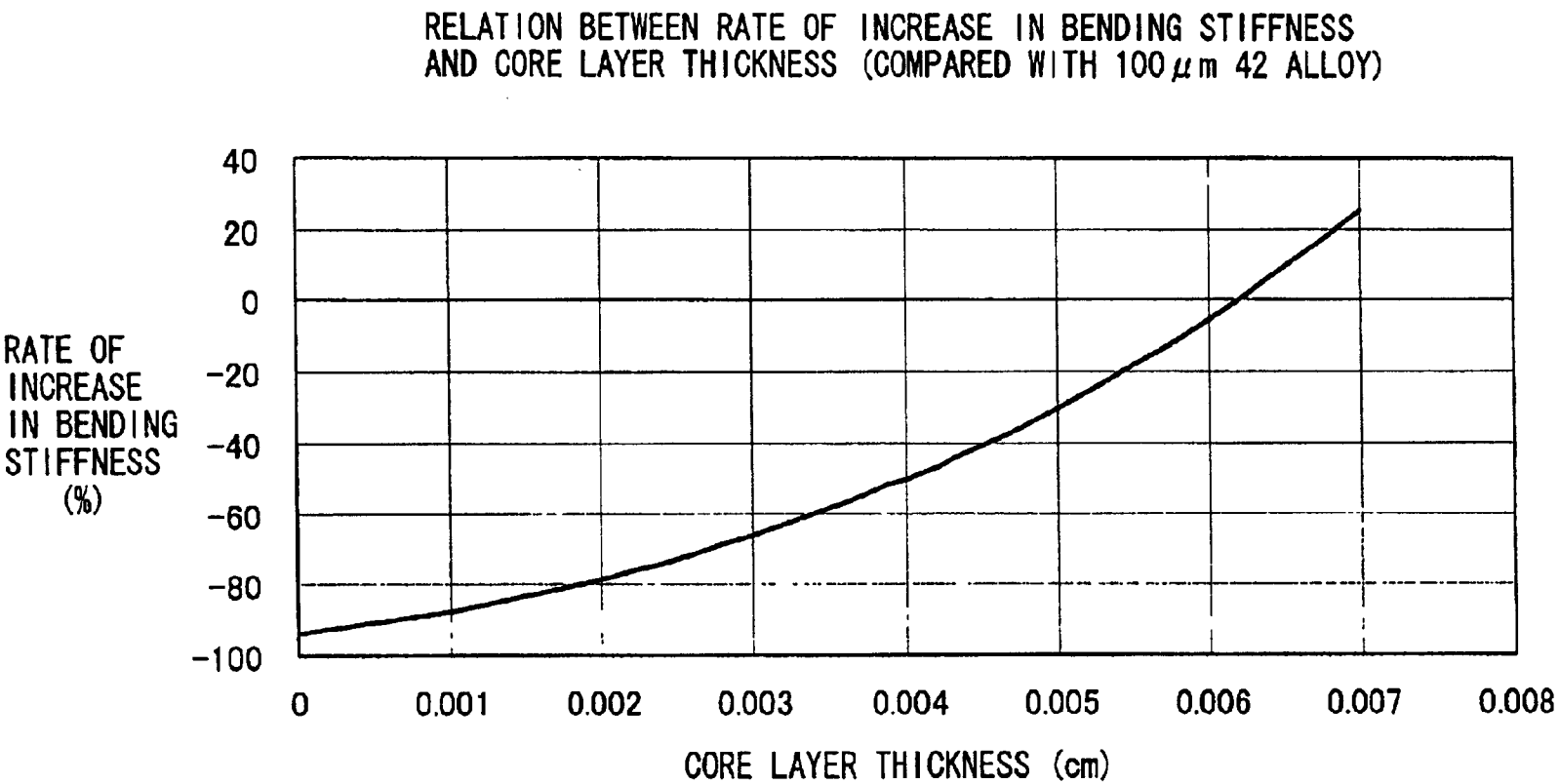
FIG. 9 is a graph showing a relation between a rate of increase in bending stiffness of a diaphragm for use in the piezoelectric speaker 10 of FIG. 7 and a layer thickness of a core material.

With reference to FIG. 9, a rate of increase in the entire bending stiffness that varies by changing the layer thickness of the core material of the diaphragm material is described below. FIG. 9 is a graph obtained through simulations by using the above equation (1), showing a relation between a rate (%) of increase in bending stiffness and the thickness (cm) of the core material.

In FIG. 9, the rate (%) of increase in bending stiffness indicated on the vertical axis of the graph is calculated with reference to the above-mentioned 42 alloy material having the thickness of 100 μm used for the conventional piezoelectric speaker. On the other hand, the horizontal axis thereof indicates a core layer thickness (cm) representing the thickness of the aluminium used as the core material. Here, the surface materials used on both the top and bottom surfaces are made of 42 alloy having a constant thickness of 20 μm. As illustrated in FIG. 9, when the rate of increase in bending stiffness is 0% (that is, the bending stiffness is the same as that of the 42 alloy material having the thickness of 100 μm used for the conventional piezoelectric speaker), the core layer thickness is approximately 0.006 cm. Therefore, by using the 42 alloy having the thickness of 20 μm as the surface materials and the aluminium having the thickness of 60 μm as the core material, the diaphragm material having the thickness of 100 μm of the present invention can be made closer in bending stiffness to the diaphragm material made solely of the 42 alloy having the total thickness of 100 μm.

Figure 10:
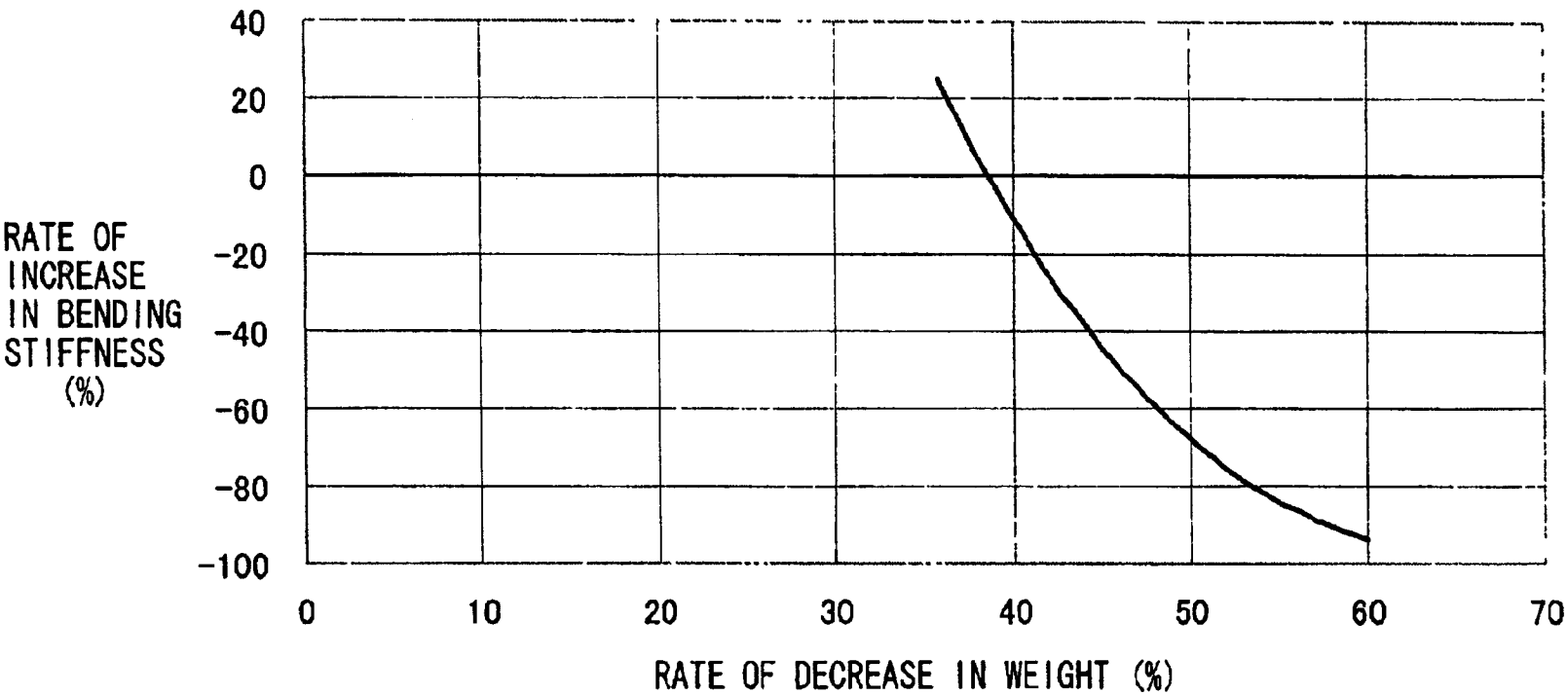
FIG. 10 is a graph showing a relation between a rate of increase in bending stiffness of the diaphragm for use in the piezoelectric speaker 10 of FIG. 7 and a rate of decrease in weight.

With reference to FIG. 10, a rate of decrease in entire weight with respect to the above-described rate of increase in bending stiffness is described. FIG. 10 is a graph obtained through simulations by using the above equation (1), showing a relation between the rate (%) of increase in bending stiffness of the diaphragm for use in the piezoelectric speaker 10 of FIG. 7 and the rate (%) of decrease in weight.

In FIG. 10, the rate (%) of increase in bending stiffness indicated on the vertical axis of the graph and the rate (%) of decrease in weight indicated on the horizontal axis thereof are calculated with reference to those of the 42 alloy material having the thickness of 100 μm used for the conventional piezoelectric speaker. In either rate, the surface material is made of 42 alloy having a constant thickness of 20 μm, but the core material made of aluminium has a varying thickness so as to vary the entire bending stiffness and weight. As illustrated in FIG. 10, when the rate of increase in bending stiffness is 0% (that is, when the bending stiffness is the same as that of the above-mentioned 42 alloy material having the thickness of 100 μm used for the conventional piezoelectric speaker), the rate of decrease in weight is approximately 40%. On the other hand, as described above, in the diaphragm material of the present invention, when the rate of increase in bending stiffness is 0%, the layer thickness of the core material is 60 μm. Therefore, when the core material made of the aluminium having the thickness of 60 μm is sandwiched between the surface materials made of the 42 alloy each having the thickness of 20 μm to form a diaphragm material having the total thickness of 100 μm, the formed diaphragm has a bending stiffness similar to that of the conventional diaphragm made solely of the 42 alloy having the total thickness of 100 μm, but weights approximately 60% of the conventional diaphragm. That is, the diaphragm material of the present invention can have the same thickness as that of the conventional diaphragm material with the bending stiffness and a thermal coefficient of expansion equivalent of the surfaces of the diaphragm material that are similar to those of the conventional diaphragm material. Also, the diaphragm material of the present invention can achieve reduction in weight.

Figure 11:
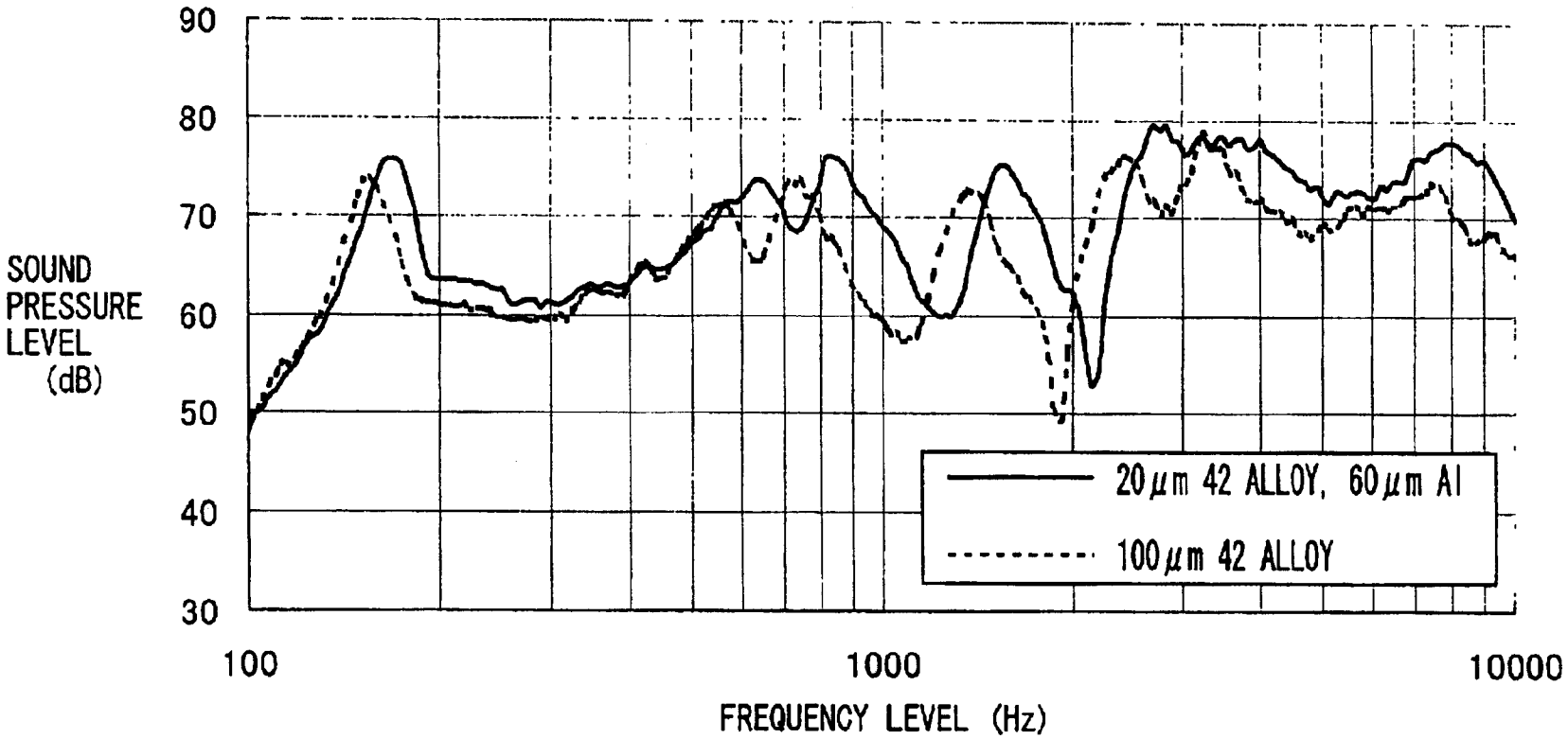
FIG. 11 is a graph showing a comparison in acoustic features between the piezoelectric speaker 10 of FIG. 7 and the piezoelectric speaker whose diaphragm is composed solely of 42 alloy.

With reference to FIG. 11, the acoustic features of the piezoelectric speaker 10 using the sandwich laminate diaphragm material are described. FIG. 11 is a graph showing a comparison in acoustic features between the piezoelectric speaker 10 and a conventional piezoelectric speaker whose diaphragm is composed solely of 42 alloy.

In FIG. 11, the horizontal axis of the graph indicates a frequency level (Hz) of sound produced from the piezoelectric speaker, while the vertical axis of the graph indicates a sound pressure level (dB) of the sound. The conventional piezoelectric speaker having the acoustic features denoted by a dotted line in the graph is constructed so that the diaphragm thereof is made solely of the 42 alloy material having the thickness of 100 μm. The piezoelectric speaker 1 of the present invention having acoustic features denoted by a solid line in the graph is constructed so that the diaphragm 13 thereof is made of the surface materials made of the 42 alloy each having the thickness of 20 μm and the core material made of the aluminium having the thickness of 60 μm. As illustrated in FIG. 11, the acoustic features of the piezoelectric speaker 10 of the present invention are improved in sound pressure level (by approximately 4 dB on average), compared with the conventional acoustic features.

In the above description, the core material is made of aluminium. This is not meant to be restrictive. For example, the core material may be made of manganese-copper alloy featuring low internal loss, or a metal film such as a magnesium film or a titanium film featuring light weight. Alternatively, the core material may be made of plastic material such as polyethylene terephthalate, polyethylene, polypropylene, polyurethane, polyamide, or polyimide; or a high polymer film made of elastomer or rubber high-polymer resin such as styrene-butadiene rubber, butadiene rubber, butyl rubber, ethylene propylene rubber, or their metamorphoses.

Further, in the above description, the surface material is made of 42 alloy. This is because such surface material can generally have a coefficient of thermal expansion close to that of a piezoelectric element made of lead zirconate titanate (PZT) generally used for a piezoelectric speaker. This construction can achieve effects of avoiding thermal exfoliation of the surface materials from the piezoelectric element and thermal material destruction such as cracking. That is, the surface materials of the present invention may be any metal material that has a coefficient of thermal expansion close to that of the piezoelectric element. When the piezoelectric element has a coefficient of thermal expansion different from that of PZT, the metal material having a coefficient of thermal expansion close to that of the piezoelectric element is used as the surface material of the diaphragm according to the present invention. When the above-mentioned effects do not have to be sought, any metal material may be used irrespectively of the coefficient of thermal expansion of the piezoelectric element. In this case, the surface material may be made of conductive resin.

Figure 12A:
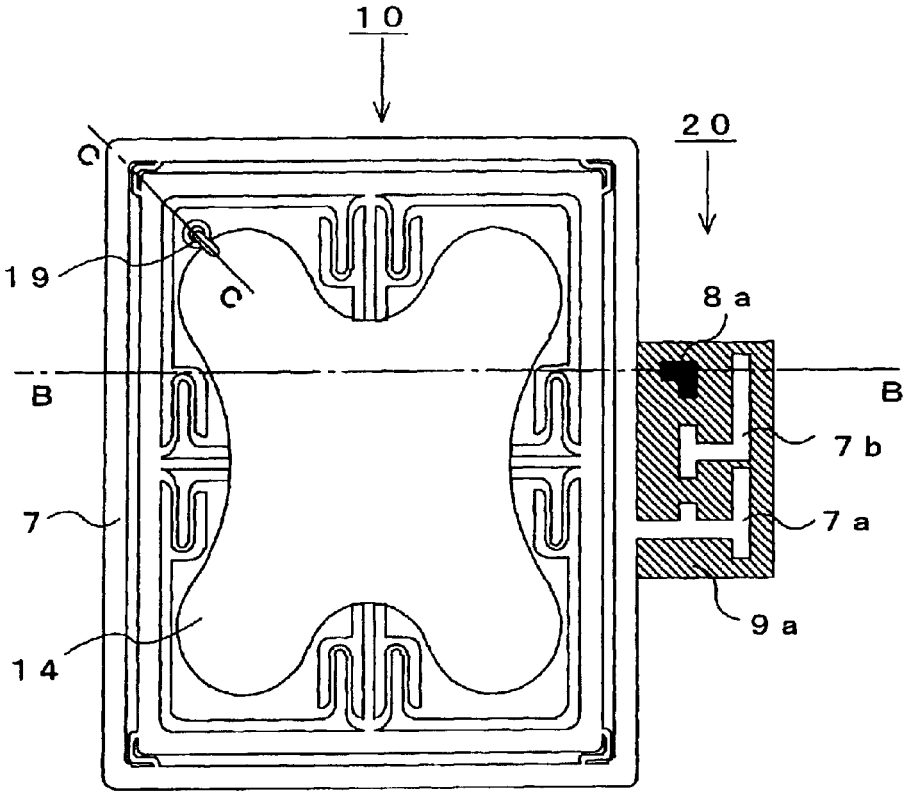
FIG. 12A is a top plan view of a circuit portion 20 integrally formed with the piezoelectric speaker of FIG. 8.
Figure 12B:
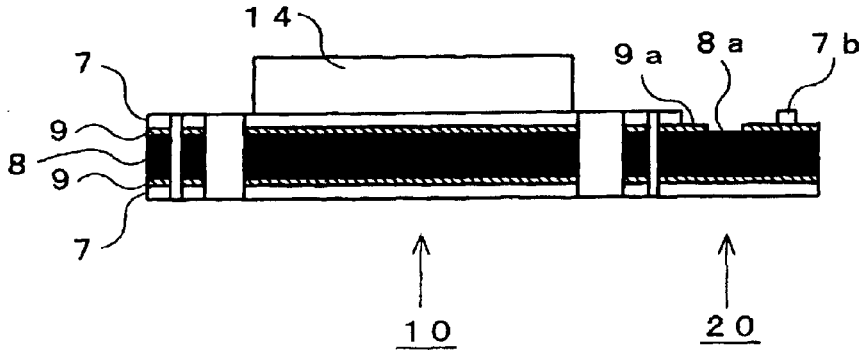
FIG. 12B is a cross-sectional view of the circuit portion 20 taken along a line B—B denoted in FIG. 12A.
Figure 12C:
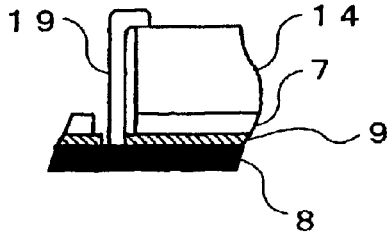
FIG. 12C is a cross-sectional view of the circuit portion 20 taken along a line C—C denoted in FIG. 12A.

Still further, in the above description, the diaphragm material is constructed so as to be a three-layer clad material having two surface materials made of 42 alloy and one core material made of aluminium. This is not meant to be restrictive: The diaphragm material may be constructed by four or more layers. For example, a high-polymer resin film is placed between each of the two conductive surface materials made of 42 alloy and the core material made of aluminium as an insulating layer, thereby constructing a five-layer diaphragm material. With this, a circuit portion can be integrally formed with the diaphragm material. With reference to FIGS. 12A through 12C, one exemplary case where the circuit portion is integrally formed with the diaphragm material is described below. In FIG. 12A, a top plan view of a circuit portion 20 integrally formed with the piezoelectric speaker 10 is illustrated. In FIG. 12B, a cross-sectional view of the circuit portion 20 taken along a line B—B denoted in FIG. 12A is illustrated. In FIG. 12C, a detailed cross-sectional view of the circuit portion 20 taken along a line C—C denoted in FIG. 12A is illustrated.

In FIG. 12B, the diaphragm material of the piezoelectric speaker 10 is constructed so as to have two conductive surface materials 7 made of 42 alloy sandwiching one core material 8 made of aluminium, with two insulating materials 9 each placed between each of the surface materials 7 and the core material 8. The insulating material 9 is a material having insulative properties, such as insulative plastic material, rubber high-polymer resin, or a high-polymer resin film. When the diaphragm material of the piezoelectric speaker 10 is formed by welding by pressure and rolling, etc., as described above, a projected portion is added for forming the circuit portion 20, as illustrated on the right of FIG. 12A. That is, a substrate of the circuit portion 20 is integrally formed with the diaphragm material of the piezoelectric speaker 10, and is made of the same five-layer clad material as that of the diaphragm material.

Then, the substrate of the circuit portion 20 integrally formed with the diaphragm material is subjected to a predetermined etching process, thereby forming a pattern. An exemplary etching process is now described. First, with reference to FIG. 12A, the 42 alloy is removed from the substrate other than portions where surface material patterns 7*a* and 7*b* formed of the surface material 7 made of 42 alloy are to be formed. Consequently, the surface material patterns 7*a* and 7*b* made of 42 alloy and an insulating material portion 9*a* are formed. Then, the insulating material is removed from a portion of the substrate where a core material pattern 8*a* formed of the core material 8 made of aluminium is to be formed. Consequently, the core material pattern 8*a* made of aluminium is formed. As a result, the circuit portion 20 having a plurality of patterns is formed. Then, on the patterns formed on the circuit portion 20 (such as, between the surface material patterns 7*a* and 7*b* and/or between the surface material pattern 7*a* and the core material pattern 8*a*), a resistor, a coil, or a capacitor having predetermined physical properties are placed, thereby arbitrarily constructing a high-pass filter, a low-pass filter, and the like.

Also, as illustrated in FIG. 12B, one surface of the piezoelectric element 14 is bonded to the conductive surface material 7 made of 42 alloy. Furthermore, as illustrated in FIG. 12C, the other surface of the piezoelectric element 14 (top surface thereof as visible in FIG. 12A) is connected to the conductive core material 8 via a lead 19. For this connection, a portion on the diaphragm material where the lead 19 is placed is subjected to a predetermined etching process for removing the surface material 7 and the insulating material 9 to form a hole. Then, the lead 19 exemplarily made of silver paste penetrates through the hole to connect the other surface of the piezoelectric element 14 and the core material 8. With this, the surfaces of the piezoelectric element 14 are connected to the surface material 7 and the core material 8. Still further, as illustrated in FIG. 12A, the surface material pattern 7*a* is connected to the outer frame portion of the piezoelectric speaker 10, and is insulated from the surface material pattern 7*b*. The surface material pattern 7*b* is connected to the core material pattern 8*a* via a predetermined component(s) placed between the surface material pattern 7*b* and the core material pattern 8*a*. That is, the surface material patterns 7*a* and 7*b* are connected to the surfaces of the piezoelectric element 14 via the damper portions of the piezoelectric speaker 10. Therefore, the surface material patterns 7*a* and 7*b* can be used as input terminals (+ and −) of audio signals supplied to the piezoelectric speaker 10. In this case, the acoustic features of the piezoelectric speaker 10 can be adjusted depending on the configuration of the circuit portion 20. Also, since the diaphragm material itself can serve as wiring to the piezoelectric element 14, no copper wires or the like are necessary to be placed on the diaphragm of the piezoelectric speaker 10. This can improve weight balance on the diaphragm, leading to improvement of the acoustic features of the piezoelectric speaker 10.

As described above, with the use of the above-structured diaphragm material, component circuits can be integrally formed on the same material without using another printed circuit made by pattern masking. Also, the etching process for forming the patterns on the circuit portion 20 can be performed simultaneously with the etching process for forming the edge portions and the damper portions.

In the above description, the surface material made of 42 alloy and the core material made of aluminium are used when the circuit portion is integrally formed with the piezoelectric speaker. This is not meant to be restrictive. The surface material and the core material may be made of other conductive metal, conductive metal alloy, or conductive resin. Also, the component packaged on the circuit portion may construct an LSI (Large Scale Integration) for electronically controlling operations of an amplifier, an operational amplifier, etc.

While the invention has been described in detail, the foregoing description is in all aspects illustrative and not restrictive. It is understood that numerous other modifications and variations can be devised without departing from the scope of the invention.

What is claimed is:

1. A piezoelectric speaker, comprising:

a piezoelectric element;

a diaphragm having placed thereon the piezoelectric element to form a vibrator;

a frame portion surrounding the diaphragm;

a damper portion connecting the frame portion and the diaphragm, and supporting the diaphragm so that the diaphragm can linearly vibrate; and an edge portion formed in an area delineated by the diaphragm, the damper portion, and the frame portion, wherein the diaphragm is made of a clad material having layers of a first material and a second material laminated together to form a sandwich structure in cross sections, wherein the first material is different than the second material, wherein the clad material includes:

two surface layers made of the first material to form a top surface and a bottom surface of the diaphragm; and a single core layer made of the second material that is different from the first material, and bonded between the two surface layers, wherein the clad material is subjected to a predetermined process to integrally form the diaphragm, the damper portion, and the frame portion on a same plane, and wherein the edge portion is formed of a different material than the first material and the second material.

2. The piezoelectric speaker according to claim 1, wherein a coefficient of thermal expansion of the first material is close to a coefficient of thermal expansion of the piezoelectric element, and a density of the second material is lower than a density of the first material.

3. The piezoelectric speaker according to claim 2, wherein each of the surface layers is thinner than the core layer.

4. The piezoelectric speaker according to claim 2, wherein the first material and the second material are each one of a metal film and a film made of high polymer resin.

5. The piezoelectric speaker according to claim 4, wherein the first material is a metal film made of 42 alloy stainless, and wherein the second material is one of a metal film made of metal other than the 42 alloy stainless, and the film made of high polymer resin.

6. The piezoelectric speaker according to claim 5, wherein the second material is a film made of aluminium.

7. The piezoelectric speaker according to claim 1, wherein the edge portion is formed by performing an etching process onto only the first material in the area delineated by the diaphragm, the damper portion, and the frame portion.

8. The piezoelectric speaker according to claim 1, wherein the piezoelectric element has provided thereon a first electrode for applying a driving voltage to the piezoelectric element, and wherein the frame portion is a second electrode electrically connected to the diaphragm via the damper portion.

9. The piezoelectric speaker according to claim 1, wherein at least a part of the clad material is made of an insulating material, and wherein the frame portion is provided with a circuit portion formed by performing an etching process onto at least a part of the layers forming the clad material.

10. The piezoelectric speaker according to claim 1, wherein the frame portion and the damper portion me made of the clad material.

* * * * *

UNITED STATES PATENT AND TRADEMARK OFFICE

CERTIFICATE OF CORRECTION

PATENT NO. : 6,978,032 B2
APPLICATION NO. : 10/305344
DATED : December 20, 2005
INVENTOR(S) : Takashi Ogura et al.

It is certified that error appears in the above-identified patent and that said Letters Patent is hereby corrected as shown below:

ON THE FRONT PAGE

Under "References Cited", "FOREIGN PATENT DOCUMENTS", please add the following references:

--JP 2-23199 2/1990
JP 3-50999 3/1991--.

IN THE CLAIMS

Column 14, line 44, "me made" should read --are made--.

Signed and Sealed this

Fifteenth Day of August, 2006

JON W. DUDAS
*Director of the United States Patent and Trademark Office*